US011112724B2

(12) United States Patent
Park et al.

(10) Patent No.: US 11,112,724 B2
(45) Date of Patent: Sep. 7, 2021

(54) STRUCTURE FOR DETECTING DEVELOPER LEVEL IN DEVELOPER CARTRIDGE

(71) Applicant: HEWLETT-PACKARD DEVELOPMENT COMPANY, L.P., Spring, TX (US)

(72) Inventors: Jong Hyun Park, Suwon (KR); Myung Kook Ahn, Pangyo (KR); Seil Kwon, Pangyo (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/982,901

(22) PCT Filed: Jul. 27, 2018

(86) PCT No.: PCT/KR2018/008495
§ 371 (c)(1),
(2) Date: Sep. 21, 2020

(87) PCT Pub. No.: WO2019/203394
PCT Pub. Date: Oct. 24, 2019

(65) Prior Publication Data

US 2021/0003940 A1 Jan. 7, 2021

(30) Foreign Application Priority Data

Apr. 19, 2018 (KR) ..... 10-2018-0045698

(51) Int. Cl.
*G03G 15/08* (2006.01)

(52) U.S. Cl.
CPC ..... *G03G 15/0862* (2013.01); *G03G 15/0879* (2013.01)

(58) Field of Classification Search
CPC ..... G03G 15/0849; G03G 15/0853; G03G 15/0855; G03G 15/0856; G03G 15/0858;
(Continued)

(56) References Cited

U.S. PATENT DOCUMENTS 5,428,427 A * 6/1995 Lee ..... G03G 15/0856 399/30
5,784,665 A * 7/1998 Bae ..... G03G 15/0896 399/27

(Continued)

FOREIGN PATENT DOCUMENTS

EP 1471380 10/2004
EP 2093624 8/2009

(Continued)

*Primary Examiner* — William J Royer
(74) *Attorney, Agent, or Firm* — Staas & Halsey, LLP

(57) ABSTRACT

A printer including a body, a developer cartridge, and a developer level sensor. The body includes a printing unit to print an image on a print medium based on electrophotography. The developer cartridge is attachable to the body and includes a developer container including a developer, and a developer outlet provided at a length-direction side of the developer container to supply the developer from the developer container to the printing unit. The developer level sensor is installed on the body near the developer outlet to generate an electrical detection signal based on a developer level in the developer container.

15 Claims, 9 Drawing Sheets

(58) Field of Classification Search
CPC ..... G03G 15/086; G03G 15/0862; G03G 15/0879
USPC ..... 399/27, 30, 61–64, 258
See application file for complete search history.

(56) References Cited

U.S. PATENT DOCUMENTS

| | | | | |
|---|---|---|---|---|
| 5,893,007 | A * | 4/1999 | Lim | G03G 15/0896 399/27 |
| 6,148,156 | A * | 11/2000 | Matsumoto | G03G 21/1867 399/27 |
| 6,445,888 | B1 * | 9/2002 | Fujiwara et al. | G03G 21/1814 399/27 |
| 7,536,130 | B2 | 5/2009 | Yokoi | |
| 8,509,651 | B2 * | 8/2013 | Tsukijima | G03G 15/0856 399/27 |
| 9,170,528 | B2 | 10/2015 | Torimoto | |
| 10,725,426 | B2 * | 7/2020 | Kumagai | G03G 15/70 |
| 2002/0057924 | A1 | 5/2002 | Ueno et al. | |
| 2007/0189781 | A1 | 8/2007 | Katogi et al. | |
| 2012/0183335 | A1 | 7/2012 | Sakuma | |
| 2012/0275823 | A1 | 11/2012 | Mizuno et al. | |
| 2015/0086229 | A1 | 3/2015 | Naruse et al. | |

FOREIGN PATENT DOCUMENTS

| | | |
|---|---|---|
| JP | 20050077419 | 3/2005 |
| JP | 2013-174753 | 9/2013 |
| KR | 1020060100487 | 9/2006 |
| KR | 20080110409 | 12/2008 |
| KR | 10-0915396 | 8/2009 |

* cited by examiner

【Figure 1】
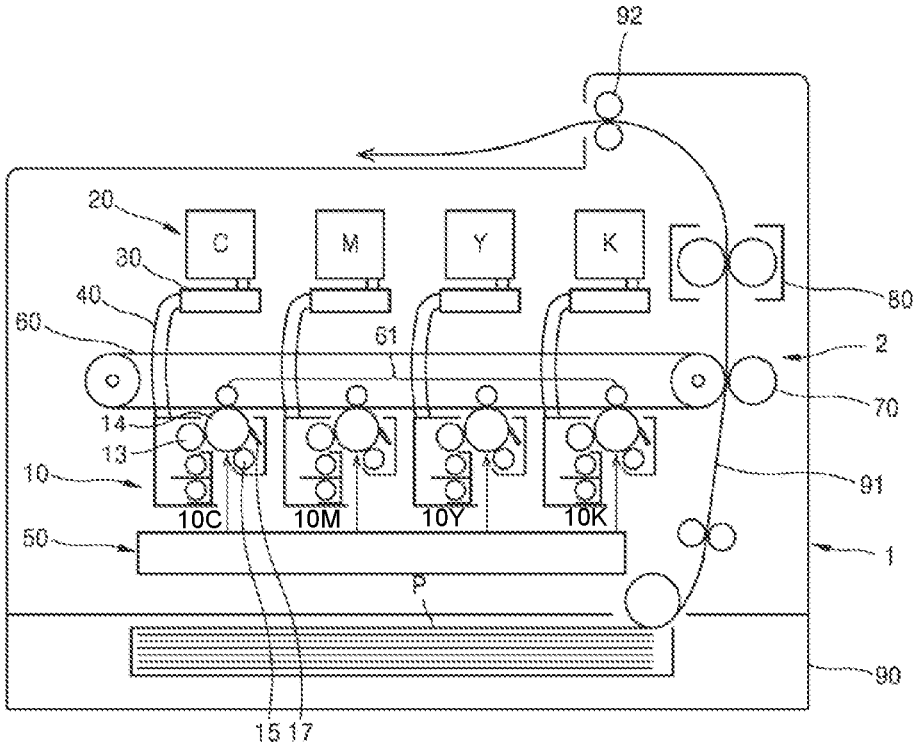

【Figure 2】
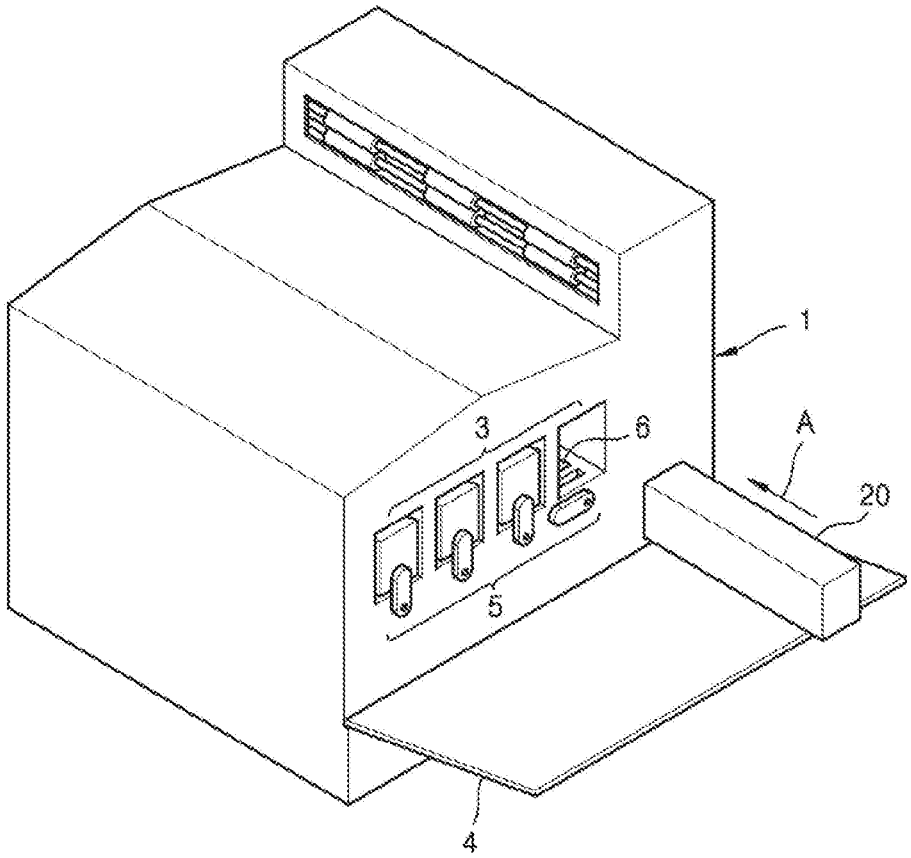
【Figure 3】
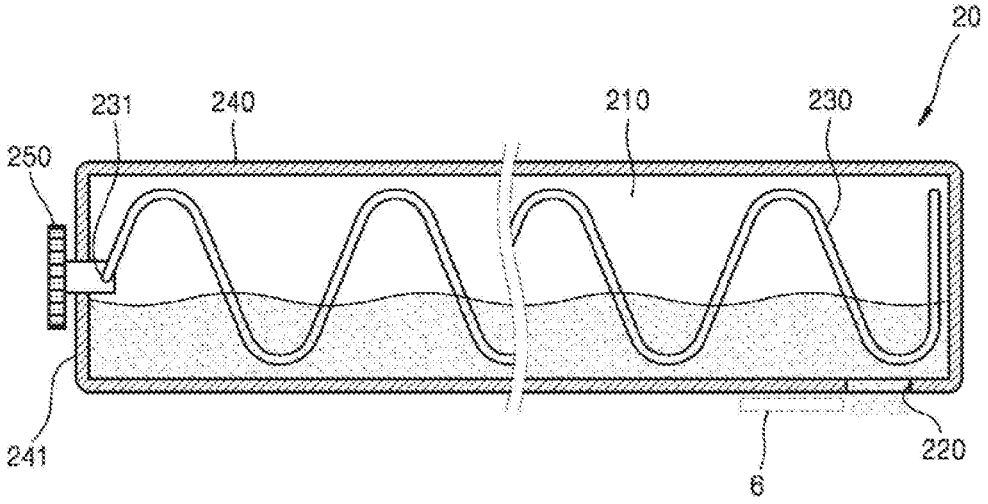

【Figure 4】
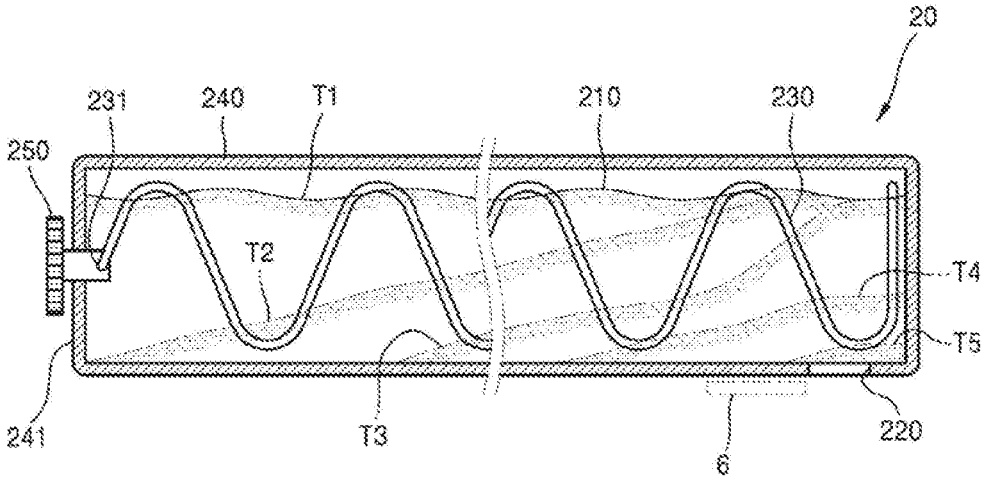

【Figure 5】
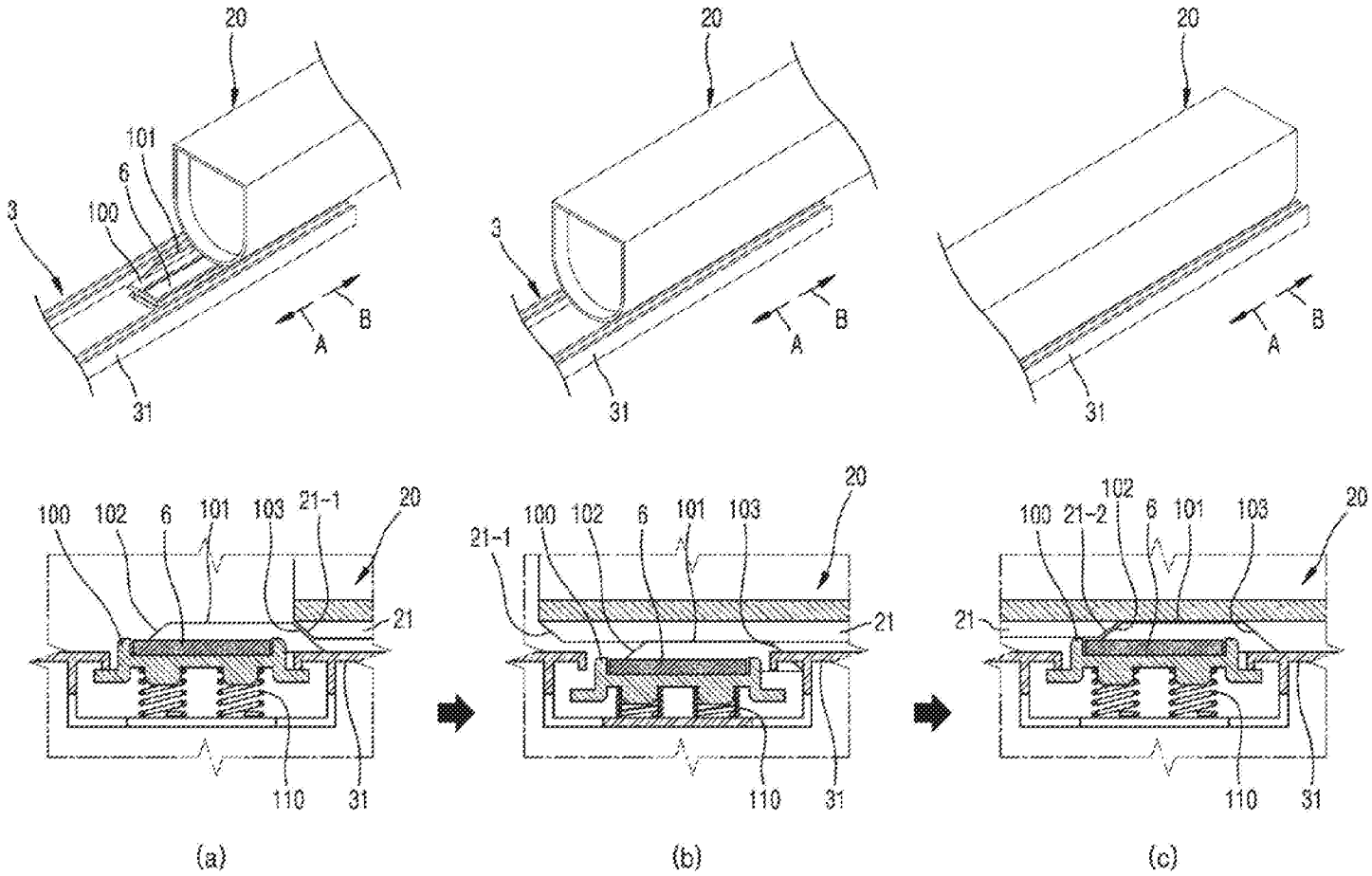

【Figure 6】
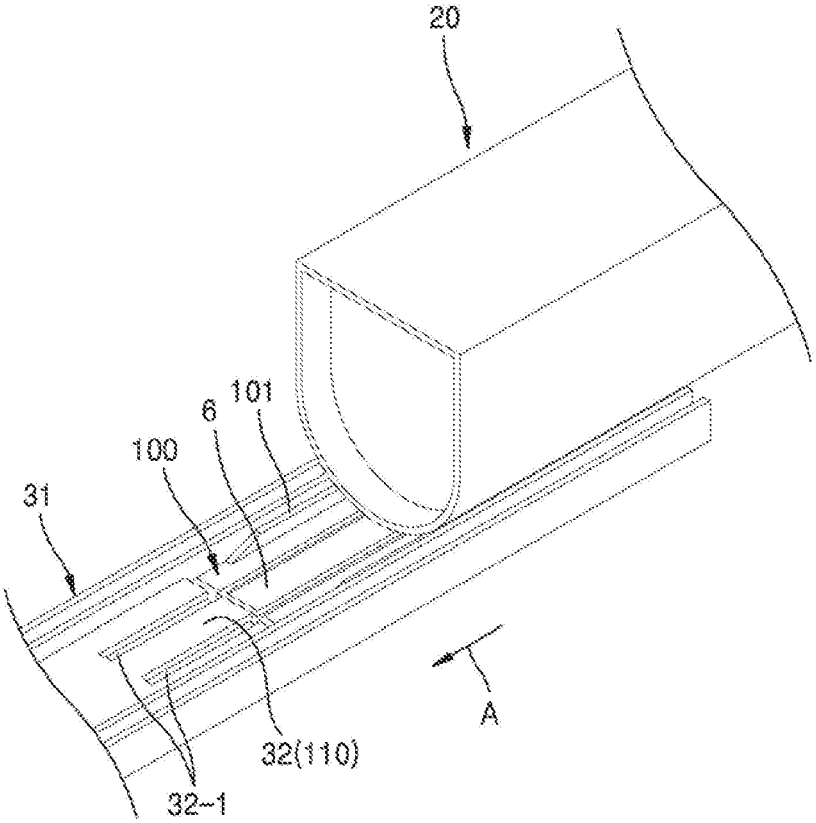
【Figure 7A】
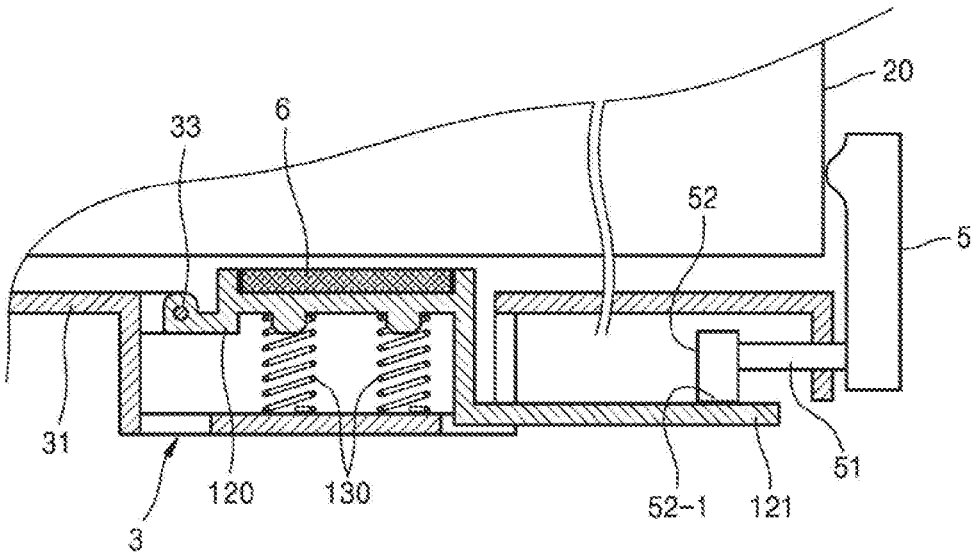

【Figure 7B】
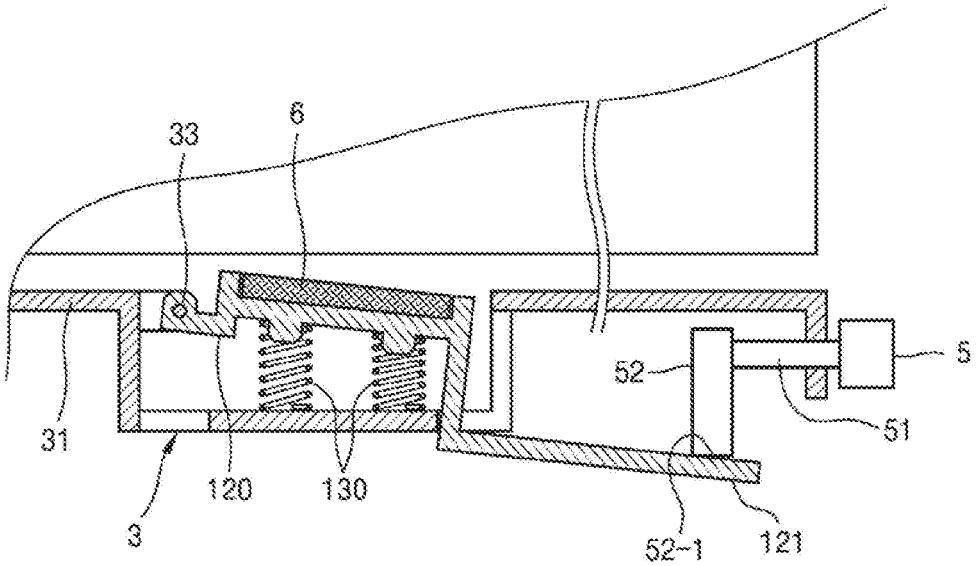
【Figure 8】
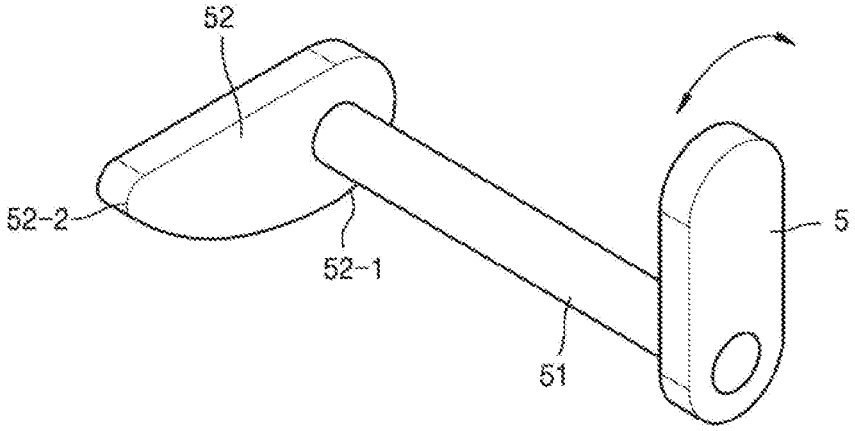

【Figure 9A】
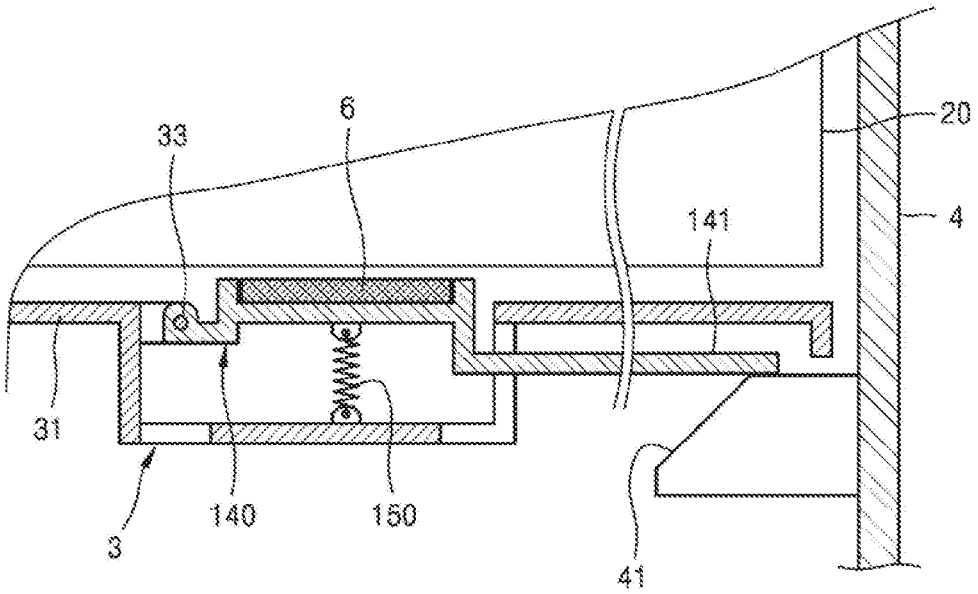
【Figure 9B】
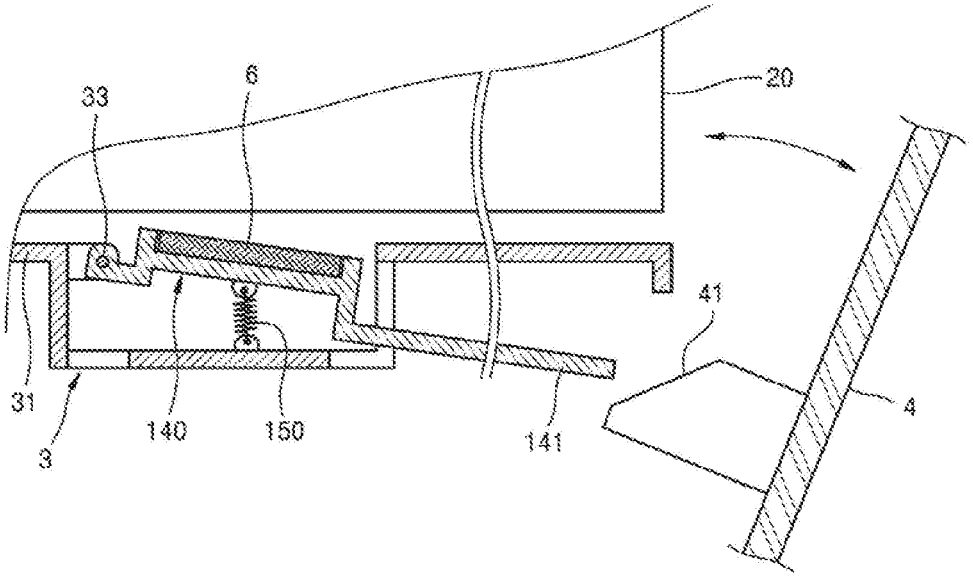

【Figure 10A】
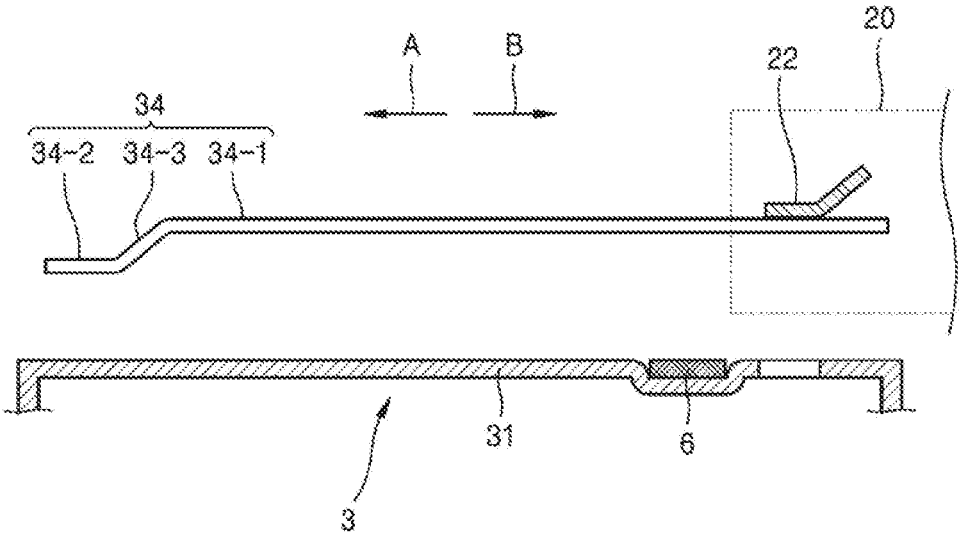
【Figure 10B】
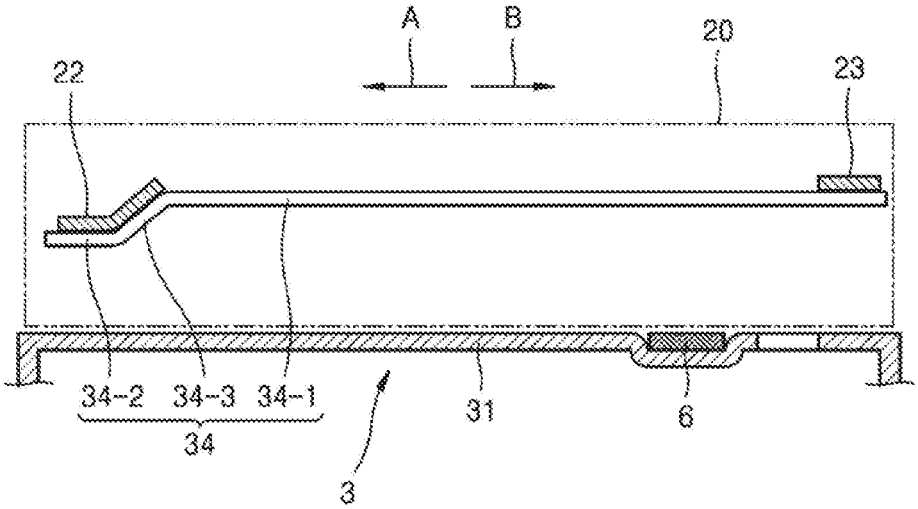

【Figure 11】
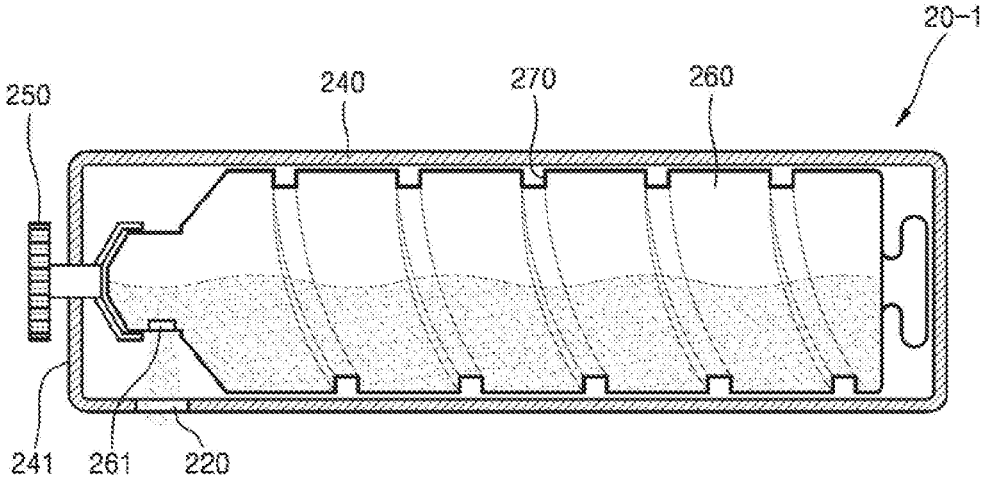
【Figure 12】
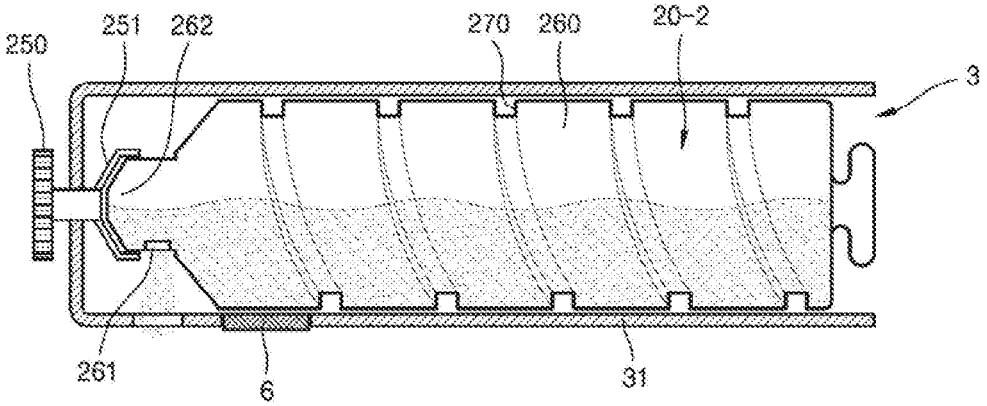

STRUCTURE FOR DETECTING DEVELOPER LEVEL IN DEVELOPER CARTRIDGE

CROSS REFERENCE TO RELATED APPLICATIONS

This application is a U.S. National Stage Application which claims the benefit under 35 U.S.C. § 371 of International Patent Application No. PCT/KR2018/008495 filed on Jul. 27, 2018, which claims priority from Korean Patent Application No. 10-2018-0045698 filed on Apr. 19, 2018, the contents of each of which are incorporated herein by reference in their entireties.

BACKGROUND ART

An electrophotographic printer forms a visible toner image on a photoconductor by supplying a toner to an electrostatic latent image formed on the photoconductor, transfers the toner image onto a print medium via an intermediate transfer medium or directly, and then fuses the transferred toner image on the print medium.

The toner is a developer and is contained in a developer cartridge. The developer cartridge is replaced when the developer contained therein runs out. A time to replace the developer cartridge may be determined by detecting a developer level in the developer cartridge. The developer level in the developer cartridge may be predicted by calculating developer consumption. The developer consumption may be predicted using the number of printed pixels, a driving time of a motor for supplying the developer to a body of the printer, or the like.

DESCRIPTION OF DRAWINGS

FIG. 1 is a cross-sectional view of an electrophotographic printer according to an example;

FIG. 2 is a perspective view of the printer according to an example;

FIG. 3 is a cross-sectional view of a developer cartridge according to an example;

FIG. 4 is a cross-sectional view illustrating a procedure of determining an installation position of a developer level sensor;

FIGS. 5(*a*)-(*c*) show perspective and cross-sectional views illustrating an example of a structure in which the developer level sensor moves to a sensing position and a separated position in conjunction with attachment and detachment operations of the developer cartridge;

FIG. 6 is a perspective view illustrating an example of a structure in which the developer level sensor moves to the sensing position and the separated position in conjunction with the attachment and detachment operations of the developer cartridge;

FIGS. 7A and 7B are cross-sectional views illustrating an example of a structure in which the developer level sensor moves to the sensing position and the separated position in conjunction with switching operations of a lock lever;

FIG. 8 is a perspective view of a lock lever according to an example;

FIGS. 9A and 9B are cross-sectional views illustrating an example of a structure in which the developer level sensor moves to the separated position and the sensing position in conjunction with opening and closing operations of a door;

FIGS. 10A and 10B are cross-sectional views illustrating an example of a structure in which the developer cartridge moves from the separated position spaced apart from the developer level sensor, to the sensing position close to the developer level sensor, when the developer cartridge is attached;

FIG. 11 is a cross-sectional view of a developer cartridge according to another example; and FIG. 12 is a cross-sectional view of a cartridge holder of the printer, according to another example.

MODE FOR INVENTION

FIG. 1 is a cross-sectional view of an electrophotographic printer according to an example. Referring to FIG. 1, the printer includes a body 1, and developer cartridges 20 attachable to the body 1. The developer cartridges 20 may also be called 'toner cartridges'. The body 1 includes a printing unit 2 to print an image on a print medium P based on electrophotography. The printing unit 2 according to the current example prints a color image on the print medium P based on electrophotography. The printing unit 2 may include a plurality of development units 10, an exposure unit 50, a transfer unit, and a fuser unit 80. Each developer cartridge 20 contains a developer to be supplied to the printing unit 2. The printer may include a plurality of developer cartridges 20 containing developers. The plurality of developer cartridges 20 are respectively connected to the plurality of development units 10, and the developers contained in the plurality of developer cartridges 20 are respectively supplied to the plurality of development units 10. Developer supply units 30 receive the developers from the developer cartridges 20 and supply the developers to the development units 10. The developer supply units 30 are connected to the development units 10 by supply tubes 40. Although not shown in FIG. 1, the developer supply units 30 may be omitted and the supply tubes 40 may direct connect the developer cartridges 20 to the development units 10.

The plurality of development units 10 may include a plurality of development units 10C, 10M, 10Y, and 10K to form cyan (C), magenta (M), yellow (Y), and black (K) toner images, respectively. The plurality of developer cartridges 20 may include a plurality of developer cartridges C, M, Y, and K respectively containing C. M, Y, and K developers to be supplied to the plurality of development units 10C, 10M, 10Y, and 10K. However, the disclosure is not limited thereto. The printer may further include the developer cartridges 20 and the development units 10 to contain and develop developers of various other colors such as light magenta and white. In the following description, it is assumed that the printer includes the plurality of development units 10C, 10M, 10Y, and 10K and the plurality of developer cartridges C, M, Y, and K and, unless otherwise defined herein, C, M, Y, and K added to reference numerals indicate elements to develop C, M, Y, and K developers, respectively.

Each development unit 10 may include a photosensitive drum 14 to form an electrostatic latent image on a surface thereof, and a development roller 13 to supply a developer to the electrostatic latent image to develop the electrostatic latent image into a visible toner image. The photosensitive drum 14 is an example of a photoconductor to form an electrostatic latent image on a surface thereof, and may include a conductive metal pipe and a photosensitive layer provided on an outer circumferential surface of the conductive metal pipe. A charge roller 15 is an example of a charger to charge the photosensitive drum 14 to have a uniform surface potential. Instead of the charge roller 15, a charge brush, a corona charger, or the like may be employed.

The development unit 10 may further include a charge roller cleaner (not shown) to remove the developer or a foreign substance, e.g., dust, adhered to the charge roller 15, a cleaning member 17 to remove the developer remaining on the surface of the photosensitive drum 14 after an intermediate transfer operation to be described below, and a regulation member (not shown) to regulate the amount of the developer supplied to a development area where the photosensitive drum 14 and the development roller 13 face each other. The cleaning member 17 may be, for example, a cleaning blade provided in contact with the surface of the photosensitive drum 14 to scrape out the developer. Although not shown in FIG. 1, the cleaning member 17 may be a cleaning brush rotating in contact with the surface of the photosensitive drum 14 to scrape out the developer.

The developer contained in the developer cartridge 20, e.g., a toner and a carrier, is supplied to the development unit 10. The development roller 13 may be spaced apart from the photosensitive drum 14. The distance between an outer circumferential surface of the development roller 13 and an outer circumferential surface of the photosensitive drum 14 may be, for example, several ten to several hundred micrometers. The development roller 13 may be a magnetic roller. In an example, the development roller 13 may be implemented as a magnet surrounded by a rotatable developing sleeve. The toner is mixed with the carrier in the development unit 10, and is adhered to the surface of the magnetic carrier. The magnetic carrier is adhered to the surface of the development roller 13 and is conveyed to the development area where the photosensitive drum 14 and the development roller 13 face each other. The regulation member regulates the amount of the developer conveyed to the development area. Due to a developing bias voltage applied between the development roller 13 and the photosensitive drum 14, the toner is supplied to the photosensitive drum 14 and thus the electrostatic latent image formed on the surface of the photosensitive drum 14 is developed into a visible toner image.

The exposure unit 50 forms electrostatic latent images on the photosensitive drums 14 by irradiating beams modulated to correspond to image information, onto the photosensitive drums 14. Examples of the exposure unit 50 include a laser scanning unit (LSU) using a laser diode as a light source, and a light-emitting diode (LED) exposure unit using an LED as a light source.

The transfer unit transfers toner images formed on the photosensitive drums 14, onto the print medium P. An intermediate transfer unit is employed in the current example. For example, the transfer unit may include an intermediate transfer belt 60, a plurality of intermediate transfer rollers 61, and a transfer roller 70.

The intermediate transfer belt 60 temporarily carries the toner images developed on the photosensitive drums 14 of the plurality of development units 10C. 10M, 10Y, and 10K. The plurality of intermediate transfer rollers 61 are provided to face the photosensitive drums 14 of the plurality of development units 10C, 10M, 10Y, and 10K across the intermediate transfer belt 60 therebetween. An intermediate transfer bias voltage for intermediately transferring the toner images developed on the photosensitive drums 14, onto the intermediate transfer belt 60 is applied to the intermediate transfer rollers 61. Instead of the intermediate transfer rollers 61, corona transfer units or pin-scorotron transfer units may be employed.

The transfer roller 70 is located to face the intermediate transfer belt 60. A transfer bias voltage for transferring the toner images transferred onto the intermediate transfer belt 60, onto the print medium P is applied to the transfer roller 70.

The fuser unit 80 applies heat and/or pressure to the toner images transferred onto the print medium P, and thus fuses the toner images on the print medium P. The fuser unit 80 is not limited to the example illustrated in FIG. 1.

According to the above-described configuration, the exposure unit 50 forms the electrostatic latent images on the photosensitive drums 14 of the plurality of development units 10C, 10M, 10Y, and 10K by irradiating multiple beams modulated to correspond to image information of multiple colors, onto the photosensitive drums 14. The electrostatic latent images of the photosensitive drums 14 of the plurality of development units 10C, 10M, 10Y, and 10K are developed into visible toner images due to the C, M, Y, and K developers supplied from the plurality of developer cartridges C. M, Y, and K to the plurality of development units 10C, 10M, 10Y, and 10K. The developed toner images are sequentially and intermediately transferred onto the intermediate transfer belt 60. The print medium P accommodated in a cassette 90 is fed along a feeding path 91 and is supplied between the transfer roller 70 and the intermediate transfer belt 60. The toner images intermediately transferred onto the intermediate transfer belt 60 are transferred onto the print medium P due to the transfer bias voltage applied to the transfer roller 70. When the print medium P passes through the fuser unit 80, the toner images are fused on the print medium P due to heat and pressure. The print medium P, on which the toner images are completely fused, is discharged by discharge rollers 92.

The plurality of developer cartridges 20 are attachable to the body 1, and may be individually replaced. When the developers contained in the developer cartridges 20 run out, the developer cartridges 20 may be replaced with new developer cartridges 20. FIG. 2 is a perspective view of the printer according to an example. Referring to FIG. 2, cartridge holders 3 to accommodate the developer cartridges 20 may be provided in the body 1. A door 4 opens or closes a part of the body 1 to attach or detach the developer cartridges 20 to or from the body 1. When the door 4 is open as illustrated in FIG. 2, the cartridge holders 3 are exposed and the developer cartridges 20 may be attached to or detached from the cartridge holders 3. Lock levers 5 to lock the developer cartridges 20 may be provided on the body 1. For example, each lock lever 5 may be switched to a lock position for locking the developer cartridge 20, and a release position for allowing attachment or detachment of the developer cartridge 20. Four lock levers 5 are illustrated in FIG. 2, and three of them are located at the lock positions whereas one is located at the release position. The lock lever 5 may be installed, for example, on the body 1 to be rotatable to the lock position and the release position.

FIG. 3 is a cross-sectional view of the developer cartridge 20 according to an example. Referring to FIG. 3, the developer cartridge 20 may include a developer container 210 containing a developer, and a developer outlet 220 provided at a length-direction side of the developer container 210 to supply the developer from the developer container 210 to the printing unit 2. The developer may be supplied to the development unit 10 through the developer outlet 220. The developer outlet 220 may be connected to the supply tube 40 (see FIG. 1). The developer outlet 220 may be connected to the developer supply unit 30 (FIG. 1). In an example, although not shown in FIG. 1, the developer outlet 220 may be directly connected to the development unit 10.

A conveying member to convey the developer to the developer outlet 220 may be installed in the developer container 210. The conveying member may be a spiral member extending in the length direction of the developer container 210. The conveying member according to the current example is a spiral coil 230. A power transmitting member 250 may be provided on a length-direction side wall 241 of a housing 240 serving as the developer container 210. An end 231 of the spiral coil 230 is connected to the power transmitting member 250. The power transmitting member 250 may be, for example, a gear or a coupler. The power transmitting member 250 may be connected to a developer supply motor (not shown) provided in the body 1. The power transmitting member 250 may be connected to a developer supply motor (not shown) provided on the developer cartridge 20. When the spiral coil 230 rotates, the developer in the developer container 210 is conveyed in the length direction toward the developer outlet 220.

As described above, the developer cartridge 20 is replaceable when the developer contained therein runs out. To check a time to replace the developer cartridge 20, a developer level in the developer cartridge 20 needs to be accurately detected.

A developer level detection method includes, for example, a method of detecting a developer level by using developer consumption based on the number of printed pixels, a method of detecting a developer level by using developer consumption based on a driving time of a developer supply motor, and a method of detecting a developer level by using developer consumption based on the number of revolutions of a gear for driving a conveying member. In the above-described methods, developer consumption is not actually measured but is predicted using the number of printed pixels, a driving time of a developer supply motor, or the number of revolutions of a gear for driving a conveying member, and a developer level is detected based on the predicted developer consumption.

However, due to various factors such as printing conditions, e.g., printed image density and print coverage, and mechanical and operational defects related to supply of the developer, the predicted developer consumption may differ from actual developer consumption. For example, when the predicted developer consumption greatly differs from the actual developer consumption, an error in detecting the developer level may be large. For example, when the predicted developer consumption is less than average consumption but the actual developer consumption is greater than the average consumption, or when the predicted developer consumption is greater than the average consumption but the actual developer consumption is less than the average consumption, an error may easily occur in determining a time to replace the developer cartridge 20. That is, the developer cartridge 20 containing a sufficient amount of the developer may be replaced. On the other hand, since the developer cartridge 20 running out of the developer may be detected as having a sufficient amount of the developer, a print error may occur, or a new developer cartridge 20 to be replaced may not be prepared in advance and thus print operation may not be performed in time.

To solve the above issues, a method of directly detecting the developer level in the developer cartridge 20 may be considered. As illustrated in FIGS. 2 and 3, the printer according to the current example includes a developer level sensor 6 to detect the developer level in the developer cartridge 20. When the developer level sensor 6 is installed on the developer cartridge 20, since there may be additional costs for the developer level sensor 6 and an electrical connection structure for transmitting a detection signal of the developer level sensor 6 to the body 1, the price of the developer cartridge 20 may be increased. According to the current example, the developer level sensor 6 is installed on the body 1. Therefore, the developer level may be precisely detected and, at the same time, the increase in the price of the developer cartridge 20 may be suppressed. The developer level sensor 6 is located near the developer outlet 220 of the developer container 210 and generates an electrical detection signal based on the developer level. For example, the developer level sensor 6 is located at an upstream side of the developer outlet 220 with respect to a direction of conveying the developer by the conveying member.

The developer level sensor 6 is not limited to any particular structure. The developer level sensor 6 may include a circuit to detect a variation in inductance based on the developer level. For example, the developer level sensor 6 may include an L-C circuit. When a conductor approaches a coil of the L-C circuit, an inductance of the L-C circuit varies. Since the carrier included in the developer includes an iron component, the inductance of the L-C circuit varies depending on the amount of the developer near the developer level sensor 6. Therefore, the developer level may be detected using the variation in the inductance. An installation position of the developer level sensor 6 may be determined to most appropriately detect a time to replace the developer cartridge 20.

FIG. 4 is a cross-sectional view illustrating a procedure of determining the installation position of the developer level sensor 6. Referring to FIG. 4, when the developer is full, the developer is dispersed in the developer container 210 as indicated by reference symbol T1. Since the developer is conveyed toward the developer outlet 220 by the conveying member, when the developer is consumed and the amount of the developer in the developer container 210 is reduced, the developer level is high near the developer outlet 220 and is low far from the developer outlet 220. Therefore, as the developer is consumed and the amount of the developer in the developer container 210 is reduced, the developer is dispersed in the developer container 210 as indicated by reference symbols T2, T3, T4, and T5. When the developer level sensor 6 is installed near the developer outlet 220, since the developer level may be detected until the developer in the developer container 210 almost runs out, a time to replace the developer cartridge 20 may be appropriately detected.

As illustrated in FIG. 4, when the developer is consumed, the developer level near the developer level sensor 6 is reduced and an output value of the developer level sensor 6 varies. According to tests, when the developer level is equal to or less than 10%, the output value of the developer level sensor 6 greatly varies depending on the variation in the developer level. Relationships between the developer level and the output value of the developer level sensor 6 based on tests may be recorded in a lookup table and stored in a storage device (not shown). The developer level may be detected by comparing the output value of the developer level sensor 6 to a pre-stored output value, and a time to replace the developer cartridge 20 may be determined based on the detected developer level. Table 1 is an example of the lookup table.

TABLE 1

| Developer level (%) | Output value of developer level sensor (ADC value) |
|---|---|
| 30 | 220 |
| 25 | 216 |
| 20 | 212 |
| 15 | 206 |
| 10 | 197 |
| 5 | 182 |
| 4 | 178 |
| 3 | 172 |
| 2 | 163 |
| 1 | 148 |

The developer level sensor 6 is in contact with or is located as close as possible to the developer cartridge 20. In this case, when attached to or detached from the body 1, the developer cartridge 20 may contact and damage a sensing surface of the developer level sensor 6. Considering this, the developer cartridge 20 or the developer level sensor 6 may be located at a separated position, at which the developer cartridge 20 and the developer level sensor 6 are spaced apart from each other, while the developer cartridge 20 is being attached to the body 1, and may be located at a sensing position, at which the developer cartridge 20 and the developer level sensor 6 are close to each other, when the developer cartridge 20 reaches an attached position. The separated position and the sensing position may be spaced apart from each other in a direction perpendicular to an attachment direction A of the developer cartridge 20. At the sensing position, the developer level sensor 6 may not be in contact with the developer cartridge 20. In an example, at the sensing position, the developer level sensor 6 may be in contact with the developer cartridge 20. For example, at the sensing position, the sensing surface of the developer level sensor 6 may be in contact with the housing 240 of the developer cartridge 20 near the developer outlet 220.

The developer level sensor 6 may be installed on the body 1 to be movable to the separated position and the sensing position. The developer level sensor 6 may move to the sensing position and the separated position in conjunction with attachment and detachment operations of the developer cartridge 20.

FIG. 5 shows perspective and cross-sectional views illustrating an example of a structure in which the developer level sensor 6 moves to the sensing position and the separated position in conjunction with the attachment and detachment operations of the developer cartridge 20.

Referring to FIG. 5, a sensor holder 100 is installed on the body 1 to be movable to the sensing position and the separated position. The developer level sensor 6 is mounted on the sensor holder 100. The cartridge holder 3 to accommodate the developer cartridge 20 may be provided in the body 1 as illustrated in FIG. 2, and the sensor holder 100 may be installed on the cartridge holder 3. The cartridge holder 3 may include an attachment frame 31 to guide the developer cartridge 20 in such a manner that the developer cartridge 20 may slide in the attachment direction A or a detachment direction B opposite to the attachment direction A, and thus may be attached to or detached from the body 1. For example, the sensor holder 100 may be installed on the attachment frame 31 to be movable toward or away from the developer cartridge 20. An elastic member 110 applies an elastic force to the sensor holder 100 in a direction toward the sensing position. The elastic member 110 may include, for example, compression coil springs supported between the sensor holder 100 and the attachment frame 31. Although not shown in FIG. 5, the elastic member 110 may be implemented as any of various springs, e.g., a tension coil spring, a leaf spring, or a torsion spring. In an example, the elastic member 110 may be implemented as an elastic sponge (not shown) supported between the sensor holder 100 and the attachment frame 31.

The sensor holder 100 includes a first interferer 101. The first interferer 101 may have, for example, a rib shape protruding from the sensor holder 100 toward the developer cartridge 20 and extending in the attachment direction A of the developer cartridge 20. The developer cartridge 20 may include a second interferer 21 extending in the attachment direction A. When the developer cartridge 20 is detached, the second interferer 21 pushes the first interferer 101 and moves the sensor holder 100 to the separated position. When the developer cartridge 20 is located at the attached position, the second interferer 21 does not interfere with the first interferer 101 in such a manner that the sensor holder 100 returns to the sensing position. For example, the second interferer 21 may have a rib shape protruding from the housing 240 of the developer cartridge 20 and extending in the attachment direction A. Both ends 102 and 103 of the first interferer 101 in the attachment direction A may be inclined downward and upward, respectively. Both ends 21-1 and 21-2 of the second interferer 21 in the attachment direction A may be inclined upward and downward, respectively. As such, when the developer cartridge 20 is attached or detached, the first and second interferers 101 and 21 may softly interfere with each other and the sensor holder 100 may stably move from the sensing position to the separated position or vice versa.

Referring to FIG. 5(*a*), the sensor holder 100 is located at the sensing position due to the elastic force of the elastic member 110. When a front end of the developer cartridge 20 is placed at an entrance of the cartridge holder 3 and is pushed into the cartridge holder 3 in the attachment direction A, the second interferer 21 contacts the first interferer 101. When the developer cartridge 20 slides in the attachment direction A, as illustrated in FIG. 5(*b*), the sensor holder 100 moves in a direction opposite to the direction of the elastic force of the elastic member 110, and the developer level sensor 6 is located at the separated position spaced apart from the developer cartridge 20. Before the developer cartridge 20 reaches the attached position, contact between the first and second interferers 101 and 21 is maintained and the developer level sensor 6 is maintained at the separated position. Therefore, contact between the sensing surface of the developer level sensor 6 and the developer cartridge 20 may be prevented. When the developer cartridge 20 reaches the attached position as illustrated in FIG. 5(*c*), contact between the first and second interferers 101 and 21 is released. Then, the sensor holder 100 returns to the original position thereof due to the elastic force of the elastic member 110, and the developer level sensor 6 is located at the sensing position.

To detach the developer cartridge 20, the developer cartridge 20 is pulled in the detachment direction B in the state illustrated in FIG. 5(*c*). Then, the second interferer 21 contacts the first interferer 101. When the developer cartridge 20 slides in the detachment direction B, as illustrated in FIG. 5(*b*), the sensor holder 100 moves in a direction opposite to the direction of the elastic force of the elastic member 110, and the developer level sensor 6 is located at the separated position spaced apart from the developer cartridge 20. When the developer cartridge 20 is completely detached, contact between the first and second interferers 101 and 21 is released, the sensor holder 100 returns to the original position thereof due to the elastic force of the elastic member 110, and the developer level sensor 6 is located at the sensing position.

FIG. 6 is a perspective view illustrating an example of a structure in which the developer level sensor 6 moves to the sensing position and the separated position in conjunction with the attachment and detachment operations of the developer cartridge 20. Referring to FIG. 6, the current example differs from the example of FIG. 5 in that the sensor holder 100 is integrated with the attachment frame 31. The sensor holder 100 is connected to the attachment frame 31 by an elastic arm 32. The elastic arm 32 is located between a pair of slots 32-1 cut in the attachment frame 31 and extending in the attachment direction A. The elastic arm 32 serves as the elastic member 110 illustrated in FIG. 5. According to the above-described configuration, the number of components of a structure for moving the developer level sensor 6 to the sensing position and the separated position may be reduced and thus a material cost and an assembly cost may also be reduced. To complement a reduction in an elastic force of the elastic arm 32 based on time, an elastic sponge (not shown) to provide an elastic force to push the sensor holder 100 toward the developer cartridge 20 may be added between the sensor holder 100 and the attachment frame 31.

Referring to FIG. 2, the lock lever 5 is installed on the body 1 to be switchable to the lock position for fixing the developer cartridge 20 to the body 1, and the release position for allowing attachment or detachment of the developer cartridge 20. The developer level sensor 6 may move to the sensing position and the separated position in conjunction with the switching operations of the lock lever 5 to the lock position and the release position.

FIGS. 7A and 7B are cross-sectional views illustrating an example of a structure in which the developer level sensor 6 moves to the sensing position and the separated position in conjunction with the switching operations of the lock lever 5. Referring to FIGS. 7A and 7B, a sensor holder 120 is installed on the body 1 to be movable to the sensing position and the separated position. The developer level sensor 6 is mounted on the sensor holder 120. The cartridge holder 3 to accommodate the developer cartridge 20 may be provided in the body 1 as illustrated in FIG. 2, and the sensor holder 120 may be installed on the cartridge holder 3. The cartridge holder 3 may include the attachment frame 31 to guide the developer cartridge 20 in such a manner that the developer cartridge 20 may slide in an attachment or detachment direction to be attached to or detached from the body 1. For example, the sensor holder 120 may be installed on the attachment frame 31 to be movable toward or away from the developer cartridge 20. The sensor holder 120 according to the current example rotates about a hinge 33 with respect to the attachment frame 31 and moves to the sensing position and the separated position. An elastic member 130 applies an elastic force to the sensor holder 120 to rotate in a direction toward the sensing position. The elastic member 130 may include, for example, compression coil springs supported between the sensor holder 120 and the attachment frame 31. Although not shown in FIGS. 7A and 7B, the elastic member 130 may be implemented as any of various springs, e.g., a tension coil spring, a leaf spring, or a torsion spring. In an example, the elastic member 130 may be implemented as an elastic sponge (not shown) supported between the sensor holder 120 and the attachment frame 31. The sensor holder 120 may include an interferer 121 extending to an opposite side of the hinge 33.

The lock lever 5 may move the sensor holder 120 to the separated position in a direction opposite to the direction of the elastic force of the elastic member 130 when the lock lever 5 is switched from the lock position to the release position, and allow the sensor holder 120 to move to the sensing position due to the elastic force of the elastic member 130 when the lock lever 5 is switched from the release position to the lock position. The lock lever 5 may be installed, for example, on the body 1 to be rotatable to the lock position and the release position. FIG. 8 is a perspective view of the lock lever 5 according to an example. Referring to FIG. 8, the lock lever 5 may include a switching portion 52 to move the sensor holder 120 in a direction opposite to the direction of the elastic force of the elastic member 130 when the lock lever 5 is switched from the lock position to the release position, and to allow the sensor holder 120 to move to the sensing position due to the elastic force of the elastic member 130 when the lock lever 5 is switched from the release position to the lock position.

The switching portion 52 may, for example, interfere with the interferer 121. The switching portion 52 may extend from a rotation shaft 51 of the lock lever 5 in a radius direction. The switching portion 52 may include a first cam 52-1 facing and contacting the interferer 121 at the lock position, and a second cam 52-2 contacting the interferer 121 at the release position. A radius of the second cam 52-2 from the rotation shaft 51 is greater than that of the first cam 52-1. Therefore, when the lock lever 5 is switched from the lock position to the release position, the second cam 52-2 pushes the interferer 121 of the sensor holder 120 in a direction opposite to the direction of the elastic force of the elastic member 130 and moves the sensor holder 120 to the separated position. When the lock lever 5 is switched from the release position to the lock position, the first cam 52-1 may face the interferer 121 and allow the sensor holder 120 to move to the sensing position due to the elastic force of the elastic member 130.

Referring to FIG. 7A, the developer cartridge 20 is attached to the cartridge holder 3 and is located at the attached position. The lock lever 5 is located at the lock position for locking the developer cartridge 20 not to be released from the cartridge holder 3. The first cam 52-1 of the switching portion 52 faces and contacts the interferer 121 of the sensor holder 120. The developer level sensor 6 is located at the sensing position close to the developer cartridge 20.

In this state, the lock lever 5 rotates and is switched to the release position as illustrated in FIG. 7B. The second cam 52-2 of the switching portion 52 contacts the interferer 121 of the sensor holder 120 and pushes the interferer 121 downward. The sensor holder 120 rotates about the hinge 33 in a direction opposite to the direction of the elastic force of the elastic member 130, and the developer level sensor 6 moves to the separated position spaced apart from the developer cartridge 20. The developer level sensor 6 is maintained at the separated position while the lock lever 5 is maintained at the release position. Therefore, contact between the sensing surface of the developer level sensor 6 and the developer cartridge 20 may be prevented while the developer cartridge 20 is being attached to or detached from the cartridge holder 3.

After the developer cartridge 20 is attached to the cartridge holder 3, when the lock lever 5 is switched to the lock position as illustrated in FIG. 7A, the first cam 52-1 of the switching portion 52 faces and contacts the interferer 121 of the sensor holder 120, the sensor holder 120 rotates about the hinge 33 in a direction toward the developer cartridge 20 due to the elastic force of the elastic member 130, and the developer level sensor 6 reaches the sensing position.

Although not shown in FIGS. 7A and 7B, the sensor holder 120 may be integrated with the attachment frame 31. In this case, the sensor holder 120 may be connected to the attachment frame 31 by the elastic arm 32 illustrated in FIG. 6. The elastic arm 32 simultaneously serves as the hinge 33 and the elastic member 130. According to the above-described configuration, the number of components of a structure for moving the developer level sensor 6 to the sensing position and the separated position may be reduced and thus a material cost and an assembly cost may also be reduced. To complement a reduction in an elastic force of the elastic arm 32 based on time, an elastic sponge (not shown) to provide an elastic force to push the sensor holder 120 toward the developer cartridge 20 may be added between the sensor holder 120 and the attachment frame 31.

Referring to FIG. 2, the printer includes the door 4 to open or close a part of the body 1 to attach or detach the developer cartridge 20 to or from the body 1. The developer level sensor 6 may move to the separated position and the sensing position in conjunction with the opening and closing operations of the door 4.

FIGS. 9A and 9B are cross-sectional views illustrating an example of a structure in which the developer level sensor 6 moves to the separated position and the sensing position in conjunction with the opening and closing operations of the door 4. Referring to FIGS. 9A and 9B, a sensor holder 140 is installed on the body 1 to be movable to the sensing position and the separated position. The developer level sensor 6 is mounted on the sensor holder 140. The cartridge holder 3 to accommodate the developer cartridge 20 may be provided in the body 1 as illustrated in FIG. 2, and the sensor holder 140 may be installed on the cartridge holder 3. The cartridge holder 3 may include the attachment frame 31 to guide the developer cartridge 20 in such a manner that the developer cartridge 20 may slide in an attachment or detachment direction to be attached to or detached from the body 1. For example, the sensor holder 140 may be installed on the attachment frame 31 to be movable toward or away from the developer cartridge 20. The sensor holder 140 according to the current example rotates about the hinge 33 with respect to the attachment frame 31 and moves to the sensing position and the separated position. An elastic member 150 applies an elastic force to the sensor holder 140 to rotate in a direction toward the separated position. The elastic member 150 may include, for example, a tension coil spring, two ends of which are separately connected to the sensor holder 140 and the attachment frame 31. Although not shown in FIGS. 9A and 9B, the elastic member 150 may be implemented as any of various springs, e.g., a compression coil spring, a leaf spring, or a torsion spring. The sensor holder 140 may include an interferer 141 extending to an opposite side of the hinge 33.

The door 4 may be installed, for example, on the body 1 to be rotatable to a closed position (see FIG. 9A) and an open position (see FIG. 9B). The door 4 includes a protrusion 41 to interfere with the interferer 141 and rotate the sensor holder 140 to locate the developer level sensor 6 at the sensing position when the door 4 is at the closed position. When the door 4 is at the open position, the protrusion 41 is spaced apart from the interferer 141 and the sensor holder 140 returns to the separated position due to the elastic force of the elastic member 150.

Referring to FIG. 9A, the developer cartridge 20 is attached to the cartridge holder 3 and is located at the attached position. The door 4 is at the closed position. The protrusion 41 is in contact with the interferer 141 of the sensor holder 140. The developer level sensor 6 is located at the sensing position close to the developer cartridge 20.

In this state, the door 4 rotates to the open position as illustrated in FIG. 9B. Then, the protrusion 41 is spaced apart from the interferer 141 of the sensor holder 140, and the sensor holder 140 rotates downward about the hinge 33 due to the elastic force of the elastic member 150. The developer level sensor 6 is located at the separated position spaced apart from the developer cartridge 20. The developer level sensor 6 is maintained at the separated position due to the elastic force of the elastic member 150 while the door 4 is maintained at the open position. Therefore, contact between the sensing surface of the developer level sensor 6 and the developer cartridge 20 may be prevented while the developer cartridge 20 is being attached to or detached from the cartridge holder 3.

After the developer cartridge 20 is attached to the cartridge holder 3, when the door 4 rotates to the closed position as illustrated in FIG. 9A, the protrusion 41 contacts the interferer 141 of the sensor holder 140, the sensor holder 140 rotates about the hinge 33 in a direction toward the developer cartridge 20, and the developer level sensor 6 reaches the sensing position.

Although not shown in FIGS. 9A and 9B, the sensor holder 140 may be integrated with the attachment frame 31. In this case, the sensor holder 140 may be connected to the attachment frame 31 by the elastic arm 32 illustrated in FIG. 6. The elastic arm 32 simultaneously serves as the hinge 33 and the elastic member 150. In this case, the elastic arm 32 may be in a free state as illustrated in FIG. 9A, or may be in a state having elastic restoring force as illustrated in FIG. 9B. According to the above-described configuration, the number of components of a structure for moving the developer level sensor 6 to the sensing position and the separated position may be reduced and thus a material cost and an assembly cost may also be reduced.

In the above-described example, the developer level sensor 6 moves to the sensing position and the separated position in a direction perpendicular to an attachment or detachment direction of the developer cartridge 20. In an example, the developer level sensor 6 may be located at a fixed position of the body 1 and the developer cartridge 20 may move from the separated position spaced apart from the developer level sensor 6, to the sensing position close to the developer level sensor 6, when the developer cartridge 20 is attached.

FIGS. 10A and 10B are cross-sectional views illustrating an example of a structure in which the developer cartridge 20 moves from the separated position spaced apart from the developer level sensor 6, to the sensing position close to the developer level sensor 6, when the developer cartridge 20 is attached.

Referring to FIGS. 10A and 10B, the developer level sensor 6 may be installed on the cartridge holder 3 of the body 1, for example, on the attachment frame 31. The cartridge holder 3 includes a guide rail 34, and the developer cartridge 20 includes a follower 22 guided by the guide rail 34. The guide rail 34 may include a first rail 34-1 extending in the attachment direction A of the developer cartridge 20, and a second rail 34-2 stepped from the first rail 34-1 in a direction perpendicular to the attachment direction A toward the developer level sensor 6. With respect to the direction perpendicular to the attachment direction A, a distance from the developer level sensor 6 to the first rail 34-1 is greater than a distance to the second rail 34-2. When the developer cartridge 20 is located at the attached position, the follower 22 is guided by the second rail 34-2. The guide rail 34 may further include a third rail 34-3 inclined to softly connect the first rail 34-1 to the second rail 34-2.

As illustrated in FIG. 10A, when the developer cartridge 20 is attached to the cartridge holder 3, the follower 22 is supported by the first rail 34-1. Before the developer cartridge 20 reaches the attached position, since the follower 22 is supported by the first rail 34-1, the developer cartridge 20 is maintained at the separated position spaced apart from the developer level sensor 6, and contact between the sensing surface of the developer level sensor 6 and the developer cartridge 20 may be prevented.

When the developer cartridge 20 reaches the attached position, as illustrated in FIG. 10B, the follower 22 leaves the first rail 34-1 and is supported by the second rail 34-2. In this case, the whole developer cartridge 20 moves toward the developer level sensor 6, and is located at the sensing position. As illustrated in FIG. 10B, the developer cartridge 20 may further include a retainer 23 supported by the first rail 34-1 when the developer cartridge 20 is located at the attached position. As such, the developer cartridge 20 may be stably maintained at the sensing position.

When the developer cartridge 20 is detached, the developer cartridge 20 slides from the attached position in the detachment direction B and the follower 22 leaves the second rail 34-2 and is guided by the first rail 34-1. In this procedure, the developer cartridge 20 immediately moves from the sensing position to the separated position. Therefore, when the developer cartridge 20 is detached, contact between the sensing surface of the developer level sensor 6 and the developer cartridge 20 may be prevented.

In the above-described example, the developer cartridge 20 has a structure in which the developer container 210 is implemented using the housing 240 and the conveying member is installed in the developer container 210 as illustrated in FIG. 3. However, the structure of the developer cartridge 20 may be variously changed.

FIG. 11 is a cross-sectional view of a developer cartridge 20-1 according to another example. Referring to FIG. 11, a cylindrical developer container 260 is accommodated in the housing 240. An opening 261 is provided at a length-direction end of the developer container 260. The developer is supplied from the developer container 260 into the housing 240 through the opening 261. The developer outlet 220 is provided at a length-direction side of the housing 240 to supply the developer to the printing unit 2. The developer outlet 220 may be located near the opening 261. A spiral structure 270 is provided in an outer circumferential surface of the developer container 260. The power transmitting member 250 may be provided on the length-direction side wall 241 of the housing 240. The developer container 260 is connected to the power transmitting member 250. The power transmitting member 250 may be connected to a developer supply motor (not shown) provided on the body 1, or a developer supply motor (not shown) provided on the developer cartridge 20. When the developer container 260 rotates in connection with the power transmitting member 250, the developer in the developer container 260 is conveyed toward the opening 261 by the spiral structure 270. In addition, the developer in the housing 240 is conveyed toward the developer outlet 220. Therefore, the spiral structure 270 serves as the conveying member of the developer cartridge 20 illustrated in FIG. 3.

The structures for moving the developer level sensor 6 and the developer cartridge 20 toward or away from each other in FIGS. 4 to 10B may also be applied to the developer cartridge 20-1 illustrated in FIG. 11.

In FIG. 11, the cylindrical developer container 260 including the spiral structure 270 in the outer circumferential surface thereof, and the opening 261 at the length-direction end thereof may serve as a replaceable developer cartridge. FIG. 12 is a cross-sectional view of a cartridge holder 3 of the printer, according to another example. Referring to FIG. 12, a developer cartridge 20-2 includes the cylindrical developer container 260 including the spiral structure 270 in the outer circumferential surface thereof, and the opening 261 at the length-direction end thereof. The cartridge holder 3 to accommodate the developer cartridge 20-2 is provided in the body 1. The power transmitting member 250 is provided on the cartridge holder 3. The power transmitting member 250 may include a coupler 251 connected to an end 262 of the developer container 260. When the developer cartridge 20-2 is attached to the cartridge holder 3, the power transmitting member 250 is connected to the developer container 260. The power transmitting member 250 is connected to a developer supply motor (not shown) provided on the body 1, and the developer container 260 rotates in connection with the power transmitting member 250. The developer in the developer container 260 may be conveyed toward the opening 261 by the spiral structure 270 and be supplied to the printing unit 2 through the opening 261. The opening 261 corresponds to the developer outlet 220 of the developer cartridge 20 illustrated in FIG. 3.

To prevent contact between the developer cartridge 20-2 and the developer level sensor 6 when the developer cartridge 20-2 is attached to or detached from the cartridge holder 3, the structure illustrated in FIGS. 7A and 7B or 9A and 9B may be employed. As illustrated in FIGS. 7A and 7B, the developer level sensor 6 may move to the sensing position and the separated position in conjunction with the switching operations of the lock lever 5 to the lock position and the release position. In an example, as illustrated in FIGS. 9A and 9B, the developer level sensor 6 may move to the separated position and the sensing position in conjunction with the opening and closing operations of the door 4.

While examples have been described with reference to the drawings, it will be understood by those of ordinary skill in the art that various changes in form and details may be made therein without departing from the spirit and scope as defined by the following claims.

The invention claimed is:

1. A printer comprising:

a body including a printing unit to print an image on a print medium based on electrophotography;

a developer cartridge attachable to the body, the developer cartridge including a developer container and a developer outlet, the developer container including a developer, the developer outlet is provided at a length-direction side of the developer container to supply the developer from the developer container to the printing unit; and a developer level sensor on the body near the developer outlet on the length-direction side of the developer container, the developer level sensor to generate an electrical detection signal based on a developer level in the developer container while the developer cartridge is attached to the body.

2. The printer of claim 1, wherein the developer cartridge further comprises a conveying member to convey the developer toward the developer outlet, and wherein the developer level sensor is located at an upstream side of the developer outlet with respect to a direction of conveying the developer by the conveying member.

3. The printer of claim 2, wherein the developer level sensor is movable to a sensing position adjacent to the developer cartridge, and the developer level sensor is movable to a separated position spaced apart from the developer cartridge.

4. The printer of claim 3, wherein the developer level sensor is in contact with the developer cartridge at the sensing position.

5. The printer of claim 3, further comprising:

a sensor holder to mount the developer level sensor thereon, the sensor holder is on the body, the sensor holder is movable to the sensing position and the separated position; and an elastic member to apply an elastic force to the sensor holder toward the sensing position.

6. The printer of claim 5, further comprising:

a first interferer provided on the sensor holder; and a second interferer extending on the developer cartridge in an attachment direction to push the first interferer and move the sensor holder to the separated position when the developer cartridge is detached, and to release interference with the first interferer and return the sensor holder to the sensing position when the developer cartridge is located at an attached position.

7. The printer of claim 3, further comprising:

a sensor holder to mount the developer level sensor thereon, the sensor holder is on the body, the sensor holder is movable to the sensing position and the separated position;

a lock lever having a lock position to fix the developer cartridge to the body, and a release position to allow attachment or detachment of the developer cartridge;

an interferer provided on the sensor holder;

a first cam provided on the lock lever to face the interferer and move the sensor holder to the sensing position at the lock position; and a second cam provided on the lock lever to interfere with the interferer and move the sensor holder to the separated position at the release position.

8. The printer of claim 3, further comprising:

a door to open or close a part of the body to attach or detach the developer cartridge;

a sensor holder to mount the developer level sensor thereon, the sensor holder being on the body to be movable to the sensing position and the separated position;

an elastic member to apply an elastic force to the sensor holder toward the separated position;

an interferer provided on the sensor holder;

a protrusion provided on the door to interfere with the interferer and locate the sensor holder at the sensing position when the door is at a closed position, the protrusion is spaced apart from the interferer and allows the sensor holder to move to the separated position due to the elastic force of the elastic member when the door is at an open position.

9. A printer comprising:

a body including a printing unit to print an image on a print medium based on electrophotography;

a developer cartridge attachable to the body, the developer cartridge including a developer container and a developer outlet, the developer container including a developer, the developer outlet is provided at a length-direction side of the developer container to supply the developer from the developer container to the printing unit; and a developer level sensor on the body near the developer outlet to generate an electrical detection signal based on a developer level in the developer container, wherein the developer level sensor is located at a fixed position of the body at the length-direction side of the developer container, and wherein the developer cartridge moves from a separated position spaced apart from the developer level sensor, to a sensing position close to the developer level sensor, when the developer cartridge is attached to the body.

10. The printer of claim 9, further comprising:

a guide rail provided on the body, the guide rail including a first rail extending in an attachment direction of the developer cartridge, and a second rail stepped from the first rail toward the developer level sensor; and a follower provided on the developer cartridge to be guided by the guide rail.

11. A printer comprising:

a body comprising a printing unit to print an image on a print medium based on electrophotography, and a cartridge holder;

a developer cartridge containing a developer, attachable to the cartridge holder, the developer cartridge including a developer outlet to supply the developer to the printing unit, and a conveying member to convey the developer toward the developer outlet; and a developer level sensor on the cartridge holder near the developer outlet on a length-direction side of the developer cartridge, the developer level sensor to generate an electrical detection signal based on a developer level in the developer cartridge while the developer cartridge is attached to the cartridge holder, wherein one of the developer cartridge and the developer level sensor is movable to a sensing position, at which the developer cartridge and the developer level sensor are close to each other, and one of the developer cartridge and the developer level sensor is movable to a separated position, at which the developer cartridge and the developer level sensor are spaced apart from each other.

12. The printer of claim 11, wherein the developer level sensor moves to the sensing position in conjunction with an attachment operation of the developer cartridge to the cartridge holder, and the developer level sensor moves to the separated position in conjunction with a detachment operation of the developer cartridge from the cartridge holder.

13. The printer of claim 11, further comprising a lock lever installed on the body to be switchable to a lock position to fix the developer cartridge to the cartridge holder, and a release position to allow attachment or detachment of the developer cartridge, wherein the developer level sensor moves to the sensing position in conjunction with the lock lever being switched to the lock position, and the developer level sensor moves to the separated position in conjunction with the lock lever being switched to the release position.

14. The printer of claim 11, further comprising a door to open or close a part of the body to attach or detach the developer cartridge, wherein the developer level sensor moves to the separated position in conjunction with opening operations of the door, and the developer level sensor moves to the sensing position in conjunction with closing operations of the door.

15. The printer of claim 11, wherein the developer level sensor is located at a fixed position of the body, and wherein the developer cartridge moves from the separated position to the sensing position when the developer cartridge is attached to the body.

* * * * *